US007931382B2

(12) United States Patent
Hecht

(10) Patent No.: US 7,931,382 B2
(45) Date of Patent: Apr. 26, 2011

(54) ILLUMINATED BEVERAGE DISPENSING DEVICES

(75) Inventor: Thomas R. Hecht, Winters, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 264 days.

(21) Appl. No.: 12/053,501

(22) Filed: Mar. 21, 2008

(65) Prior Publication Data

US 2008/0232090 A1 Sep. 25, 2008

Related U.S. Application Data

(60) Provisional application No. 60/896,821, filed on Mar. 23, 2007.

(51) Int. Cl.
*F21V 33/00* (2006.01)

(52) U.S. Cl. ..... 362/96; 362/101; 362/109; 40/332; 239/526

(58) Field of Classification Search ..... 362/96, 362/101, 109; 40/332
See application file for complete search history.

(56) References Cited

U.S. PATENT DOCUMENTS

| | | | | |
|---|---|---|---|---|
| 2,414,446 | A * | 1/1947 | Carbone | 40/332 |
| 2,631,393 | A * | 3/1953 | Hetherington | 40/332 |
| 3,321,861 | A * | 5/1967 | Tate, Jr. | 40/332 |
| 4,894,647 | A * | 1/1990 | Walden et al. | 340/815.45 |
| 5,412,547 | A * | 5/1995 | Hornblad et al. | 362/183 |
| 5,491,617 | A * | 2/1996 | Currie | 362/96 |
| 7,096,617 | B2 * | 8/2006 | Bydalek et al. | 40/332 |
| 2002/0179741 | A1 * | 12/2002 | Chen | 239/526 |
| 2009/0073673 | A1 * | 3/2009 | Young | 362/97.1 |

* cited by examiner

*Primary Examiner* — Stephen F Husar
*Assistant Examiner* — James W Cranson
(74) *Attorney, Agent, or Firm* — Kilpatrick Townsend & Stockton LLP

(57) ABSTRACT

An illuminated bar gun, having a first housing portion; a second housing portion dimensioned to connect with the first housing portion and form a unitary body; a recess formed in one or both of the first and second housing portions; and an illumination source fitted within the recess. The present invention also provides an illuminated beverage dispensing handle, having a first portion and a second portion; cavities formed in the first portion and a recess formed in said second portion; and an illumination source fitted inside the cavity, the recess, or both.

8 Claims, 3 Drawing Sheets

ILLUMINATED BEVERAGE DISPENSING DEVICES

CROSS-REFERENCES TO RELATED APPLICATIONS

This application claims priority to U.S. Provisional Patent Application No. 60/896,821, filed Mar. 23, 2007 whose teachings are incorporated herein by reference.

BACKGROUND OF THE INVENTION

The present invention relates to beverage dispensers, and more specifically to illuminating the beverage dispenser or portions thereof.

Hand held bar guns that mix liquids from several components into one beverage are known in the restaurant industry. One such bar gun system is described in the assignee's patent application No. 60/989,611, entitled: "Beverage Dispensing Apparatus with Butterfly Plates and Molded Cluster Bearings," the disclosure of which is hereby incorporated by reference herein. A feature of the apparatus of the 60/989,611 application is a pair of mating recess areas in the upper and lower housing parts of the bar gun. The recess areas form a cavity where the fluid mixing apparatus is contained. The ingredients of the beverage arrive through several valve controlled inlet tubes. As the ingredients mix in the bar gun handle, they are released through the beverage outlet spout. Another bar gun system is described in the assignee's U.S. Pat. No. 4,986,449, entitled: "Beverage Dispensing Apparatus," the disclosure of which is incorporated by reference herein. When it is not necessary to mix the beverage prior to dispensing, handles that open and shut beverage container valves (typically beer containers) are used in the restaurant industry. However, the existing bar guns and handles lack good visibility needed by the operator and a visual appeal for the customers.

There is therefore a need for a bar gun or a beverage dispensing handle which is more visible, and therefore easier to operate for the operator, while also creating additional appeal and attractiveness for the customers.

BRIEF SUMMARY OF THE INVENTION

The present invention is directed toward an illuminated hand-held beverage dispensing device, for example, a bar gun or a handle. Such an illuminated bar gun or a handle can be used to improve visibility, to enhance brand identification, to increase the attraction of a particular beverage, and for novelty purposes. Different types of illumination sources, for instance rope lights or LEDs, may be placed inside the modified bar gun or the modified beverage handle housing. A variety of light effects may be used to enhance the visibility, illumination, and attractiveness of the bar guns and handles. Some examples are lights that blink, flash, or are animated.

In one embodiment, the present invention provides an illuminated bar gun, having a first housing portion; a second housing portion dimensioned to connect with the first housing portion and form a unitary body; a recess formed in one or both of the first and second housing portions; and an illumination source fitted within the recess.

In one aspect, the illumination source may be a constant, a blinking, a flashing, or an animated display of light, or some combination thereof.

In another aspect, the illumination source of the illuminated bar gun may be a light rope or LED, or some combination thereof.

In another embodiment, the present invention provides an illuminated beverage dispensing handle, having a first portion and a second portion; cavities formed in the first portion and a recess formed in the second portion; and an illumination source fitted inside the cavity, the recess, or both.

In one aspect, the illuminated beverage dispensing handle has a recess fitted with one or more LEDs near the bottom of the handle.

For a further understanding of the nature and advantages of the invention, reference should be made to the following description taken in conjunction with the accompanying figures. It is to be expressly understood, however, that each of the figures is provided for the purpose of illustration and description only and is not intended as a definition of the limits of the embodiments of the present invention.

BRIEF DESCRIPTION OF THE DRAWINGS

FIG. 3A is an exemplary diagram showing a dispensing handle with the illumination cord fitted in.

DETAILED DESCRIPTION OF THE INVENTION

Certain embodiments of the present invention are directed toward methods for illuminating and an illuminated hand-held beverage dispensing device (e.g., a bar gun or a dispensing handle). Such an illuminated dispensing device can be used to improve device visibility, enhance brand identification, increase the attraction to particular beverage, and for novelty purposes.

When a beverage dispensing device is illuminated in accordance with the embodiments of the present invention it can provide for novel brand recognition associated with the dispensing device. In addition, an illuminated beverage dispensing device can draw attention to the device through the use of one or more illumination sources. The illumination of the dispensing device also helps the operator to locate and grab the device. The sources of illumination can include light emitting diodes (LED), or electro-luminescent illumination devices (e.g. electro-luminescent rope), either of which can provide an illumination that can be constantly on, flashing, sequencing, or having animated display elements. Electro-luminescent ropes and LEDs are widely available on the market. Some examples are electro-luminescent ropes from the Light Rope family of products by Light Beam Industries, Eugene, Oreg. The same company markets LEDs through their Illuminator family of products. Many other suppliers are available.

Figure 1:
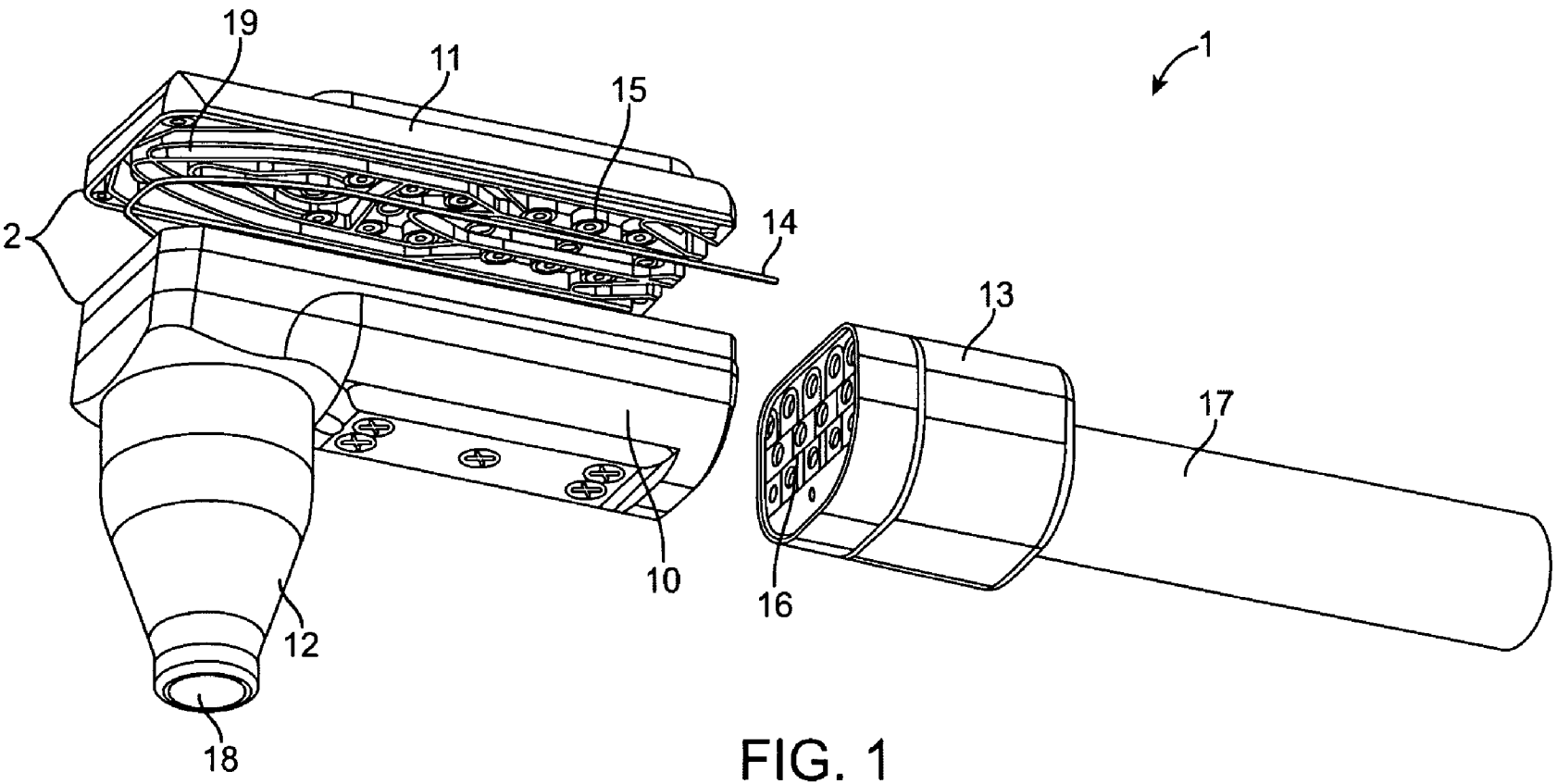
FIG. 1 is an exemplary exploded view diagram showing a bar gun with an illumination cord or rope.

FIG. 1 is a an exemplary exploded view diagram showing a bar gun 1 in accordance with one embodiment of the present invention. As seen in FIG. 1, bar gun handle 2 has first housing portion 11 and second housing portion 10. At least one of the two housing portions is recessed to receive an illumination source. For example, as shown in FIG. 1, the first housing portion 11 includes a recess 19, that is dimensioned to receive an electro-luminescent rope 14. Bar gun handle 2 can be made by molding the first and second portions and then ultrasonically welding the portions together. Alternatively, bar gun handle 2 can be made by a machining process from solid blocks and then assembled by bonding the first and second portions.

The beverage is mixed in fluid mixing mechanism 15, which is placed in the bar gun handle cavity. Fluid mixing mechanism consists of hoses, valves, and mixing chambers. The beverage ingredients are transported to handle 2 through a bundle of hoses which are routed inside conduit 17 and handle tail 13. This bundle of hoses terminates in the wall of connectors 16. A mating set of liquid connectors that is placed inside handle 2 plugs into connectors 16, and transports beverage ingredients to fluid mixing mechanism 15. The mixed beverage is discharged through opening 18 on spout 12.

An illuminating rope is illustrated in FIG. 1, but it will be clear to a person skilled in the art that LEDs or similar low power light source can also be used as a source of illumination. The electrical power for source of illumination 14 may be routed through conduit 17 or the wires may be attached on the outside of conduit 17. Preferably, source of illumination 14 can be powered by a low voltage power source, i.e. 12-24 V DC. A wall mounted converter may be conveniently located under the serving counter to convert 115 V AC line voltage down to 12-24 V DC. Alternatively, source of illumination 14 may be powered by a battery placed inside the handle cavity, or inside conduit 17, or attached onto the bar gun.

Figure 2:
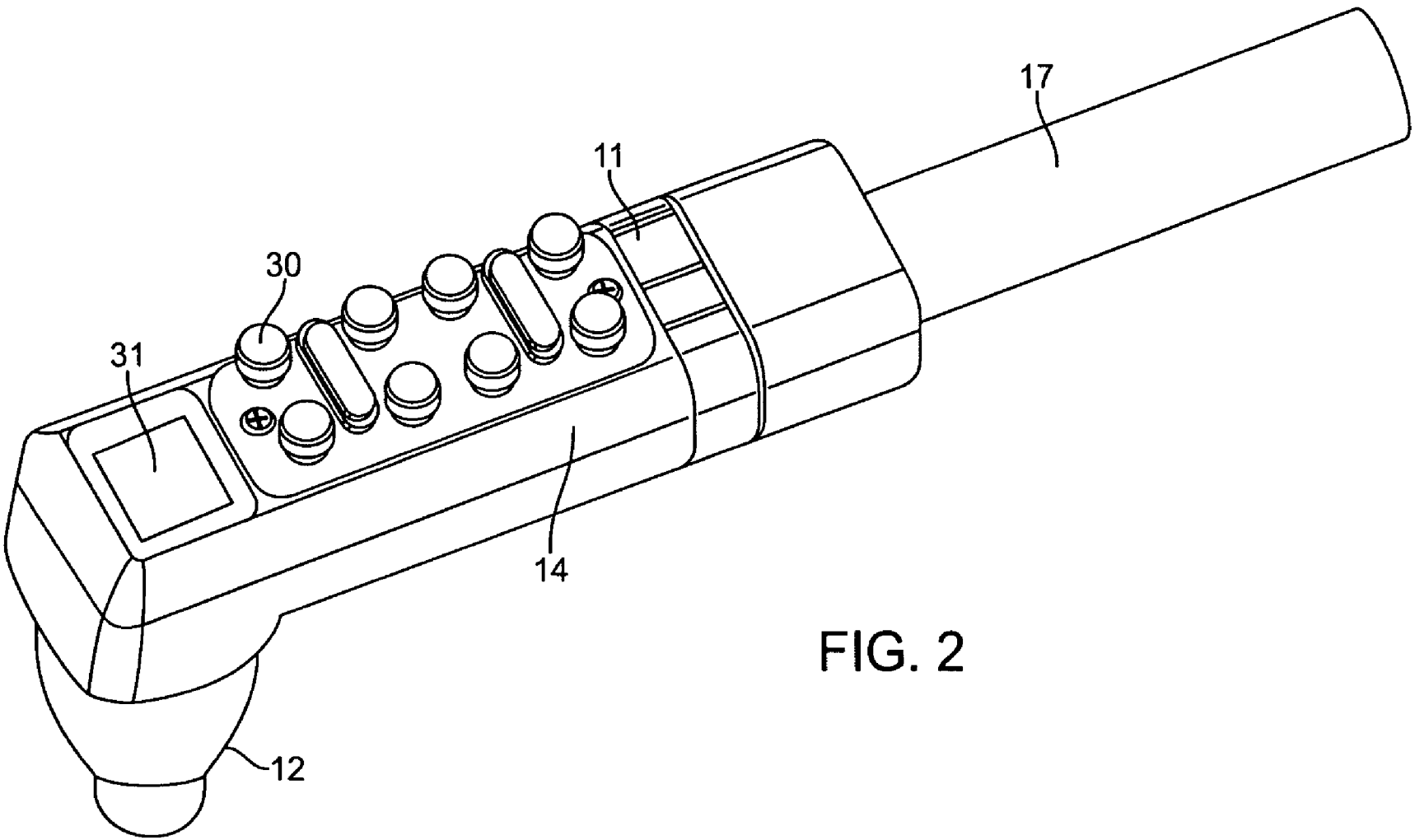
FIG. 2 is an assembled view diagram corresponding to the illuminated bar gun device of FIG. 1, showing the illumination rope in the translucent housing of the bar gun.

FIG. 2 is an assembled view diagram corresponding to the illuminated bar gun device of FIG. 1, showing illumination rope 14 through the housing portions 11 and 12 of the bar gun. One or both of housing portions 11 and 12 may be made translucent for the desired visual effect. The bar gun is operated by depressing fluid mixing buttons 30 on handle 2. FIG. 2 also shows recess 31 near the distal end of the bar gun. The recess can receive branding labels that can attain extra visibility by the illumination from within the bar gun housing. Alternatively, or in addition, the internal recess in the bar gun housing can hold LEDs that can be configured to direct their light down toward nozzle 12 at the distal end of the bar gun. In such a case it may be advantageous to also use a translucent nozzle portion to better accommodate the transmission of the light from the LED or light rope from within the housing out toward its outside portion.

Another embodiment of the present invention is directed toward an illuminated dispensing handle. Such an illuminated dispensing handle can be used to improve handle visibility, enhance brand identification, increase the attraction of a particular beverage, and for novelty purposes. An illuminated dispensing handle can be used to draw attention to the specific brand associated with the dispensing faucet lever (e.g., tap handle) through one or more sources of illumination such as electro-luminescent ropes or LEDs that use constant, a blinking, a flashing, or an animated display of light.

Figure 3A:
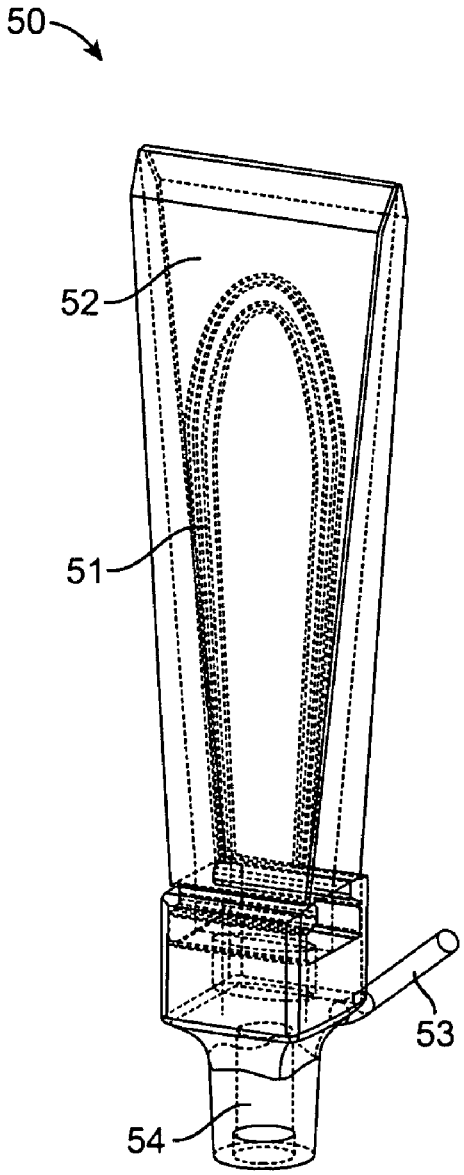

FIG. 3A is an exemplary diagram of an illuminated dispensing handle in accordance with one embodiment of the present invention. FIG. 3A shows handle 50 that includes one or more cavities 52 configured to receive illumination sources 51. Handle 50 is attached to the beverage valve through collar 54. Electrical power for illumination source 51 may be provided by conductor wires 53. Alternatively, electrical wires may be attached to collar 54 or handle 50 externally, and then routed to illumination source 51 through the openings drilled on handle 50 or collar 54. Instead of an external source of electrical power, a battery can be mounted inside the handle to provide the required power for illumination source 51.

Figure 3B:
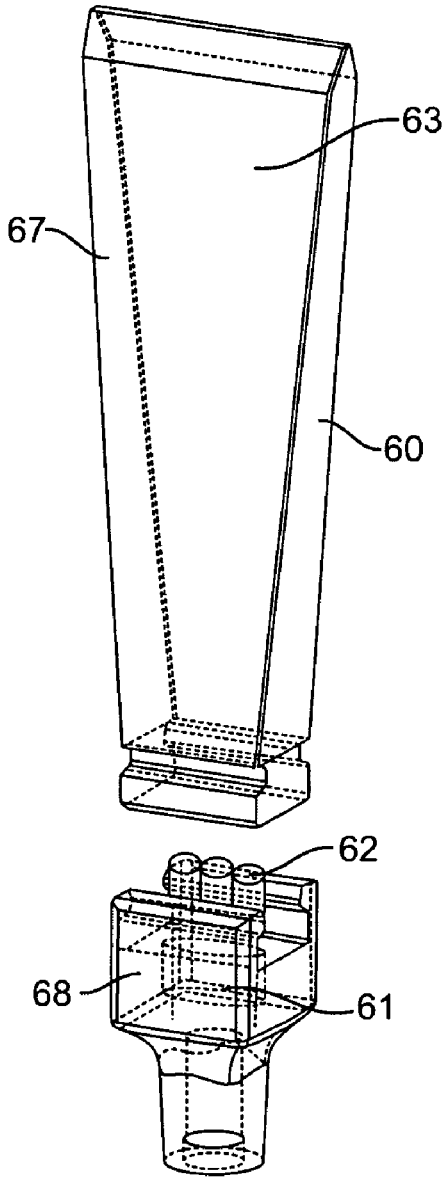
FIG. 3B is an exemplary exploded diagram showing a dispensing handle with LEDs embedded in the handle.

FIG. 3B is an exemplary exploded diagram showing another embodiment of an illuminated dispensing handle. Handle 50 has first portion 67 and second portion 68. First portion 67 may have one or more cavities dimensioned to receive an illumination source. As shown in FIGS. 3A and 3B, the first and second handle portions include complementarily shaped structure to engage one-another into a unitary body. As shown in FIGS. 3A and 3B, the recess on the top of second portion 68 is dimensioned to engage protrusion formed in first portion 67. Recess 61 in second portion 68 is dimensioned to receive one or more LEDs 62, which are used to illuminate the dispensing handle. (LEDs 62 are shown above recess 61 in FIG. 3B. When LEDs 62 are assembled in handle 50, they are housed inside recess 61.) Dispensing handle 50 may have marking, engraving, or writing 63 containing words or symbols which are illuminated by LEDs 62, thus enhancing visual appeal of the handle.

As will be understood by those skilled in the art, the present invention may be embodied in other specific forms without departing from the essential characteristics thereof. These other embodiments are intended to be included within the scope of the present invention, which is set forth in the following claims.

What is claimed is:

1. An illuminated bar gun, comprising:

a first housing portion;

a second housing portion dimensioned to connect with said first housing portion to form a unitary body;

a recess formed in one or both of said first and second housing portion;

a mixing mechanism disposed in the recess, the mixing mechanism in fluid communication with a plurality of fluid lines;

a spout having an opening in fluid communication with the mixing mechanism to discharge fluid received from the mixing mechanism; and an illumination source fitted within said recess.

2. The illuminated bar gun of claim 1, wherein at least one of said first and second housing portions is translucent.

3. The illuminated bar gun of claim 1, wherein said illumination source is selected from a group consisting of a constant, a blinking, a flashing, and an animated display of light, and a combination thereof.

4. The illuminated bar gun of claim 3, wherein said illumination source is selected from a group consisting of a light rope and a light emitting diode (LED), and a combination thereof.

5. The illuminated bar gun of claim 1, wherein said first housing portion and said second housing portion are molded and then ultrasonically welded together.

6. The illuminated bar gun of claim 1, wherein said first housing portion and said second housing portion are made by a machining process from a solid block and then bonded together.

7. The illuminated bar gun of claim 1, further comprising a recess near a distal end of the bar gun, said recess dimensioned to receive a label that is illuminated by said illumination source.

8. The illuminated bar gun of claim 1, further comprising a translucent nozzle that is illuminated by said illumination source.

* * * * *